US005408959A

United States Patent [19]

Speil

[11] Patent Number: 5,408,959

[45] Date of Patent: Apr. 25, 1995

[54] TAPPET WITH HYDRAULIC VALVE CLEARANCE COMPENSATION AND FLOATING PISTON

[75] Inventor: Walter Speil, Ingolstadt, Germany

[73] Assignee: Ina Walzlager Schaeffler KG, Germany

[21] Appl. No.: 256,633

[22] Filed: Jul. 15, 1994

[30] Foreign Application Priority Data

Jan. 22, 1992 [DE] Germany ..... 42 01 618.5

[51] Int. Cl.[6] ..... F01L 1/24

[52] U.S. Cl. ..... 123/90.55; 74/569

[58] Field of Search ..... 123/90.48, 90.49, 90.52, 123/90.55, 90.58; 74/569

[56] References Cited

U.S. PATENT DOCUMENTS 4,164,917 8/1979 Glasson ..... 123/90.15
4,867,113 9/1989 Pieprzak et al. ..... 123/90.55

FOREIGN PATENT DOCUMENTS 3935027 4/1991 Germany .
1498460 1/1978 United Kingdom .

*Primary Examiner*—Carl S. Miller
*Assistant Examiner*—Weilun Lo
*Attorney, Agent, or Firm*—Bierman and Muserlian

[57] ABSTRACT

A tappet (2) has a hydraulic clearance compensating element (8) composed of a high pressure chamber (18), a housing (3) with a spring-loaded, longitudinally movable compensating piston (15) and a free piston (11) with a smaller diameter than the compensating piston (15). In order to obtain by simple manufacturing means a reduced elasticity in valve operation during the base circle phase of a cam (6), the ratio between the projected surface (20) of the compensating piston (15) that faces the high pressure chamber (18) and the projected surface (19) of the free piston (11) that faces the high pressure chamber (18) is higher than 3.

11 Claims, 3 Drawing Sheets

TAPPET WITH HYDRAULIC VALVE CLEARANCE COMPENSATION AND FLOATING PISTON

The invention concerns a tappet comprising a housing having a jacket and a bottom, in which housing there is concentrically arranged a clearance compensation element comprised of a spring-loaded longitudinally slidable compensating piston and a high pressure chamber, said compensating piston being supported at one end on a valve shaft of an engine valve and delimiting at another end by its end face facing away from the valve shaft of the engine valve said high pressure chamber, said tappet further comprising a floating piston having a diameter smaller than that of the compensating piston and an end face on which the hydraulic pressure of the high pressure chamber acts.

Such tappets are used in the valve drives of internal combustion engines and serve to compensate length variations resulting from wear, thermal expansion and manufacturing tolerances. The hitherto known tappets compensate these length variations to a zero at the beginning of the base circle phase of the cam, that is to say, after completion of a valve stroke. This leads to a force engagement between the cam and a valve.

A disadvantage of such devices is that, for example, in the case of base circle defects of the cam or misalignment of the camshaft due to transverse vibrations and/or play in a camshaft bearing, the pressure acting on the valves during the base circle phase of the cam is reduced, or even increased. This can lead, for instance, to frictional losses, higher exhaust emissions or uneven engine running.

To overcome these disadvantages, efforts have been made to obtain a slight elasticity of the valve drive during the base circle phase of the cam.

Such a tappet equipped with a floating piston is known from GB-PS 14 98 460 in which the high pressure chamber is closed at its end opposite the compensating piston by a floating valve, Since the end face of the floating piston facing the high pressure chamber is slightly smaller than the corresponding end face of the compensating piston, a certain idle stroke effect is indeed obtained. However, the ratio between the end face areas of the floating and the compensating piston is not well selected, Due to the relatively large peripheral surface of the floating piston, its leak rate is unfavorable or proves to be difficult to pre-define in the manufacturing process. Further, an exact adjustment of the idle stroke is problematic because the ratio of the end face area of the compensating piston to the end face area of the floating piston is approximately 1.

The object of the invention is to provide a tappet having hydraulic valve clearance compensation and a floating piston, in which tappet the mentioned disadvantages are eliminated and a slight elasticity of the valve drive during the base circle phase is obtained while, at the same time, the idle stroke executed by the floating piston is exactly definable and remains almost constant during the entire operating life of the tappet which, in addition, should be easy to manufacture.

The invention achieves this object according to the characterizing part of claim 1 in that the ratio of the projected area of the end face of the compensating piston facing the high pressure chamber to the projected area of the end face of the floating piston facing the high pressure chamber is $>3$.

By this configuration, an exactly defined idle stroke can be obtained and manufacturing requirements of the floating piston are kept at a low level by reason of the above-mentioned area ratio. The aforesaid area ratio of $>3$ guarantees the effectiveness of the floating piston already in the presence of minor cam base circle defects or the like. The larger this area ratio, the more sensitive is the reaction of the floating piston, for example, to the aforesaid base circle defects, or the more inexact may be the tolerance required of the floating piston stroke.

Further features of the invention are the subject matter of the sub-claims and will be described more closely below.

Claims 2 and 3 state a preferred arrangement of the floating piston. By the arrangement in an edge region between the housing bottom and the jacket, the floating piston is separated from the compensating piston. This lodging of the floating piston in the housing can be realized by relatively simple manufacturing means.

In the embodiment of claims 4 to 6, the floating piston is mounted directly in the compensating piston. According to claim 5, the stop for the floating piston can be formed by the flange of the valve cap of the non-return valve of the compensating piston. This embodiment is relatively simple to manufacture from the constructional point of view. It is also conceivable to provide stops for the floating piston in the form of metal plates or the like inserted into the compensating piston, while the idle stroke can likewise be effected by a ball or any other suitable element. It is further possible to assist the idle stroke of the ball by means of a spring.

Claim 7 again refers directly to the spring support of the floating piston. This spring assures that, at the end of the hump phase of the cam, the floating piston is urged at first into its end position nearer the high pressure chamber so that, during the base circle phase of the cam, an idle stroke can be effected if necessary.

A possibility of realizing the leak gap with the help of the floating piston is described in claim 8. It is conceivable to define the leak rate wholly or at least in part with the help of the floating piston. The smaller leak gap circumference in this case as compared with the compensating piston permits a larger leak gap clearance. This in turn provides the possibility of larger manufacturing tolerances for the floating piston and permits the compensating piston to be fitted more tightly.

Claims 9 and 10 refer to the possibility of fixing the non-return valve of the compensating piston directly on the floating piston so that the non-return valve moves together with the floating piston during idle strokes thereof. This configuration particularly concerns the arrangement of the floating piston in a bore of the compensating piston. In this case again, no separate bore is required for lodging the floating piston.

The use of the tappet described here is not intended to be limited to the valve drive of internal combustion engines. Rather, it is conceivable to use it wherever clearance compensation is required due to thermal expansion or wear. Further, the features of the invention are not restricted to the type of tappets described here but can likewise be implemented in cup-shaped tappets acted upon directly by a cam, for example in tappets used as plug-in elements in rocker arms or finger levers.

The scope of the invention is not limited to the characterizing features of the claims, there being possibilities of combining individual claim features with the disclosures contained in the discussion of advantages and in the description of the examples of embodiment.

Examples of embodiment of the invention are represented in the drawings and will be described more closely below.

Figure 2:
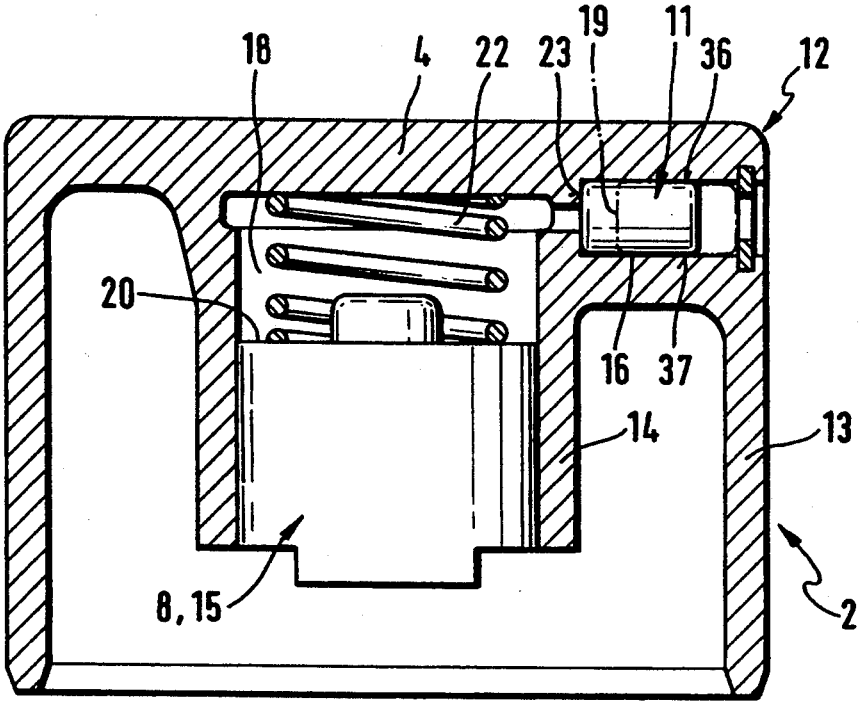
FIG. 2 is an enlarged longitudinal cross-section of a tappet.
Figure 3:
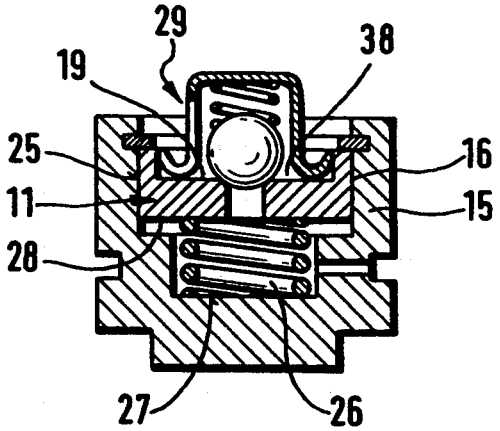
Figure 4:
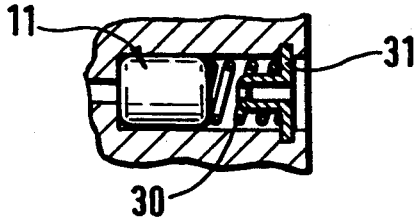
Figure 5:
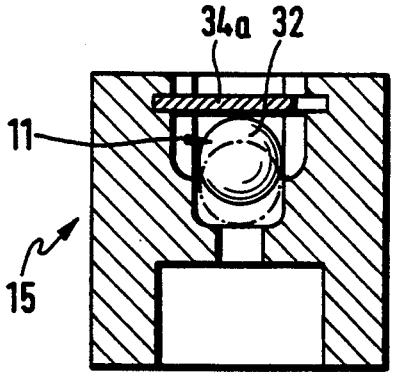
Figure 6:
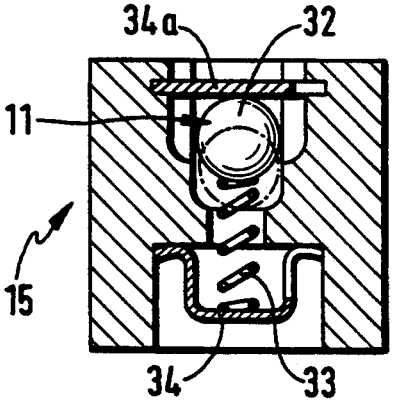
Figure 7:
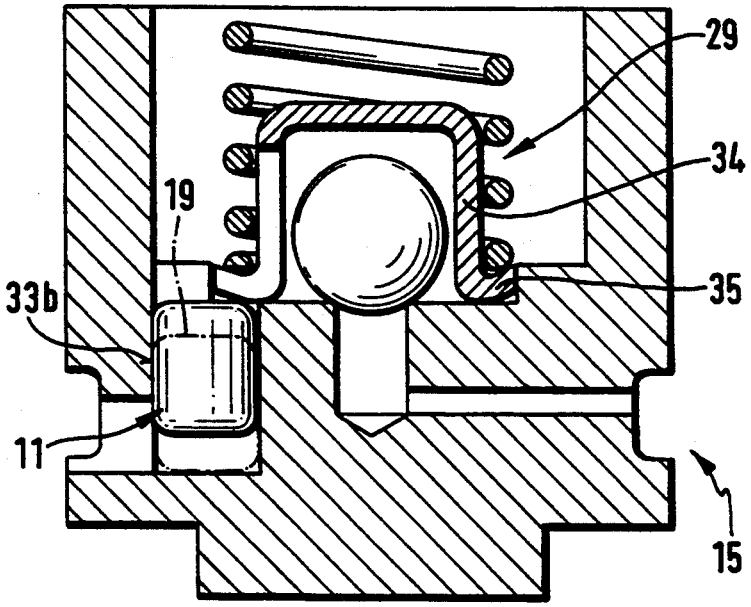

FIG. 3 is a sectional view of a compensating piston with a floating piston mounted therein, FIG. 4 is a detail of the tappet of FIG. 2 showing the floating piston, FIG. 5 is a sectional view of a compensating piston with a ball serving as an idle stroke element mounted therein, FIG. 6 is a sectional view of another compensating piston with a ball mounted therein, and FIG. 7 is a sectional view of a compensating piston with a floating piston mounted therein.

Figure 1:
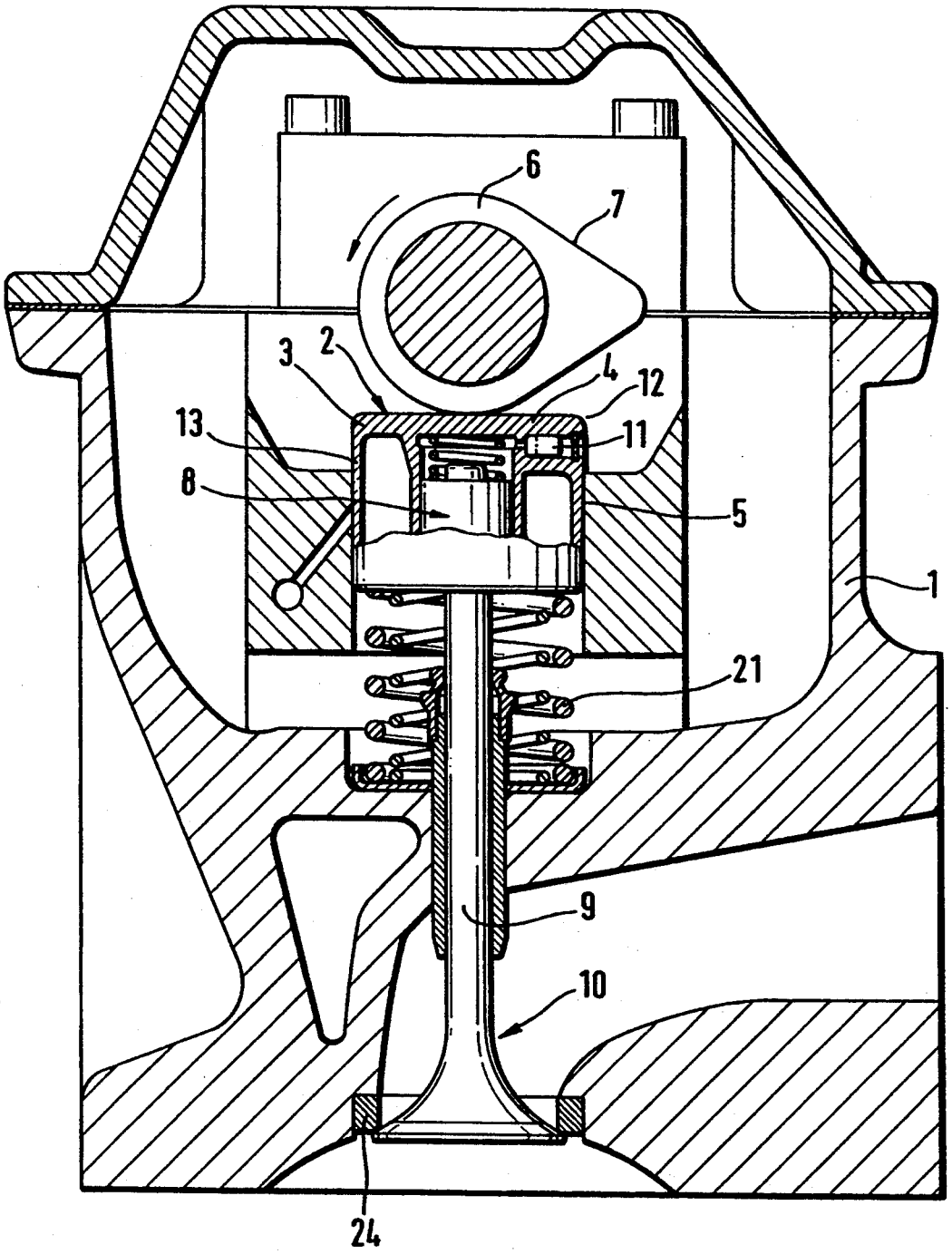
FIG. 1 is a longitudinal cross-section of the upper part of a cylinder head.

FIG. 1 is a longitudinal cross-section of the upper part of a cylinder head 1. The tappet 2 is composed of a housing 3 closed at an upper end by a bottom 4. The housing 3 is guided with the help of a slideway 5 in said cylinder head 1 of an internal combustion engine. The flank 7 of a cam 6 acting as a valve control element displaces the tappet 2 in a direction opposed to the bottom 4 of the tappet 2. The housing 3 lodges a concentrically arranged clearance compensation element 8. The structure and the mode of operation of the clearance compensation element 8 will not be described here as they are well known in the art. A spring-loaded compensating piston, not represented in this figure, bears by its front end facing away from the bottom 4 against an end, also not shown, of a valve shaft 9 of an engine valve 10. A floating valve 11 of the invention is mounted in an end region 12 formed by the bottom 4 of the housing 3 and the jacket 13 of the tappet 2. The structure and mode of functioning of the tappet 2 of the invention comprising a floating piston 11 will now be described with the help of FIGS. 2 and 4.

FIG. 2 is an enlarged longitudinal cross-section of the tappet 2. The actual clearance compensation element 8 with the compensating piston 15 is guided axially in a concentric hub 14 which starts from the bottom 4 of the tappet 2. The floating piston 11 is shown in detail in FIG. 4. When a force is exerted on the tappet 2 by the cam 6 (see FIG. 1) in an axial direction opposed to the bottom 4 of the housing 3, the compensating piston 15 is loaded. A part off the oil present in the high pressure chamber 18 is displaced and effects, at first, a displacement of the floating piston 11 towards the jacket 13. Thus, before a high pressure can be built up in the high pressure chamber 18, the floating piston 11 executes an idle stroke due to the ratio of the surface area of its end face 19 facing the high pressure chamber to the surface area of the end face 20 of the compensating piston 15 facing the high pressure chamber 18. It is only when pressure has been built up in the high pressure chamber 18, that the force engagement required for opening the valve 10 against the force of the valve spring 21 (see FIG. 1) becomes effective. During the hump phase of the cam 6 a certain small volume of oil is pressed out of the high pressure chamber 18 via a leak gap, not shown, as is also the case with known types of clearance compensation elements, so that, at the end of the hump phase of the cam 6, there is a deficiency of oil in the high pressure chamber 18. If, now, to compensate the clearance formed during the cam hump phase, the compensating piston 15 is pushed by a readjusting spring 22 in a direction opposed to the bottom 4, there takes place, at first, a movement of the floating piston 11 in the direction of the high pressure chamber 18 upto a stop 23. Following this, the pressure difference required for opening the non-return valve (see FIG. 3) can be built up thereat. The quantity of oil pressed out of the high pressure chamber 18 during the cam hump phase is now replaced by suction. If, for example, due to base circle defects of the cam 6, an undesired pressure-relief or even opening of the valve 10 relative to a valve seat ring 24 (see FIG. 1) occurs, this is compensated by the elasticity of the floating piston 11 relative to the high pressure chamber 18.

FIG. 3 is a sectional view of a compensating piston 15 with a floating piston 11 mounted therein. The floating piston 11 is seated concentrically and axially displaceable in a bore 25 of the compensating piston 15. The movement of the floating piston 11 towards the high pressure chamber 18 is assisted by a spring 26 compressed between a bottom 27 of the compensating piston 15 and a bottom 28 of the floating piston 11. The mode of operation of this compensating piston 15 of the tappet 2 and of the compensating pistons of further embodiments described in FIGS. 5, 6 and 7 is the same as that described in FIG. 2. In contrast to the solution of FIG. 2, the floating piston 11 described here is displaced together with the compensating piston 15 during the compensating movements thereof. It is possible, as shown in this example, to arrange the non-return valve 29 of the compensating piston 15 directly on the floating piston 11.

The floating piston 1 1 of FIG. 2 is shown in more detail in FIG. 4. A spring 30 bears at one end against the floating piston 11 and at the other end against a cap 31. The floating piston 1 1 is biased by the spring 30 towards the high pressure chamber 18 (see FIG. 2).

FIGS. 5 to 7 show further embodiments of the compensating piston 15 with a floating piston 11 mounted therein. As can be seen in FIGS. 5 and 6, it is possible to use a ball 32 as a floating piston 11 and to assist it, as shown in FIG. 6, by a spring 33 supported on a valve cap 34. Advantageously, the axial movement of the ball 32 is limited by a plate **34*a*** but other kinds of stops are also conceivable.

Another variant for lodging the floating piston 11 in the compensating piston 15 is shown in FIG. 7. The floating piston 11 is mounted in a bore **33*b* of the compensating piston 15 and is displaced along an axis which is substantially parallel to the central longitudinal axis of the compensating piston 15. Advantageously, a flange 35 of a valve cap 34 serves as an axial end stop for the floating piston 11**.

I claim:

1. A tappet (2) comprising a housing (3) having a jacket (13) and a bottom (4), in which housing (3) there is concentrically arranged a clearance compensation element (8) comprised of a spring-loaded longitudinally slidable compensating piston (15) and a high pressure chamber (18), said compensating piston (15) being supported at one end on a valve shaft (9) of an engine valve (10) and delimiting at another end by its end face (20) facing away from the valve shaft (9) of the engine valve (10) said high pressure chamber (18), said tappet (2) further comprising a floating piston (11) having a diameter smaller than that of the compensating piston (15) and an end face (19) on which the hydraulic pressure of the high pressure chamber (18) acts, characterized in that the ratio of the projected area of the end face (20) of the compensating piston (15) facing the high pressure chamber (18) to the projected area of the end face (19) of the floating piston (11) facing the high pressure chamber (18) is greater than 3.

2. A tappet of claim 1 wherein the floating piston (11) is arranged in a radial bore (37) of the jacket (13).

3. A tappet of claim 2 wherein the floating piston (11) is arranged in an edge region (12) formed by the bottom (4) of the housing (3) and a part of the jacket (13).

4. A tappet of claim 1 wherein the floating piston (11) is arranged in a bore (25) of the compensating piston (15).

5. A tappet of claim 4 wherein the floating piston (11) is displaced along an axis of the bore (25) which is parallel to a central longitudinal axis of the compensating piston (15).

6. A tappet of claim 4 wherein a stroke of the floating piston (11) is limited at one of its end faces (19) by a stop on a flange (35) of a valve cap (34) of a non-return valve (29) of the compensating piston (15).

7. A tappet of claim 1 wherein the floating piston (11) is biased towards the high pressure chamber (18) by a spring (30).

8. A tappet of claim 1 wherein a gap (36) formed between a radial outer surface (16) of the floating piston (11) and the bore (25) in which the floating piston (11) is arranged serves as a leak gap for a fluid medium present in the high pressure chamber (18).

9. A tappet of claim 4 wherein a non-return valve (29) of the compensating piston (15) is fixed on the end face (19) of the floating piston (11) facing the high pressure chamber (18).

10. A tappet of claim 9 wherein a valve cap (34) of the non-return valve (29) is fixed in a cylindrical recess (38) of the floating piston (11).

11. A tappet of claim 5 wherein a stroke of the floating piston (11) is limited at one end of its end faces (19) by a stop on a flange (35) of a valve cap (34) of non return valve (29) of the compensating piston (15).

* * * * *